United States Patent [19]

Nipper et al.

[11] Patent Number: 4,734,978

[45] Date of Patent: Apr. 5, 1988

[54] ASSEMBLY TOOL FOR FLAT CABLE

[75] Inventors: James H. Nipper, Lisle; Grigory Men, Naperville; Richard J. Kunzelman, Geneva, all of Ill.

[73] Assignee: Cooper Industries, Inc., Houston, Tex.

[21] Appl. No.: 58,212

[22] Filed: Jun. 4, 1987

[51] Int. Cl.[4] ..... H01R 43/04

[52] U.S. Cl. ..... 29/749; 29/759

[58] Field of Search ..... 29/749, 759, 760, 753, 29/751

[56] References Cited

U.S. PATENT DOCUMENTS 4,077,695 3/1978 Bakermans ..... 29/749 X 4,393,580 7/1983 Hall, Jr. ..... 29/749

*Primary Examiner*—Carl E. Hall

*Attorney, Agent, or Firm*—Eddie E. Scott; Nelson A. Blish; Alan R. Thiele

[57] ABSTRACT

An assembly tool for applying multi-terminal electrical connectors to multi-conductor flat electrical cable having sequentially operated sliding plates which locate and hold the flat cable against a bottom plate with the conductors precisely located in grooves in the plates.

3 Claims, 3 Drawing Sheets

Fig. 1
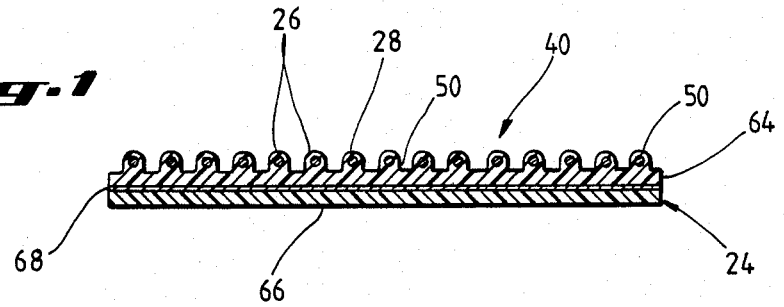
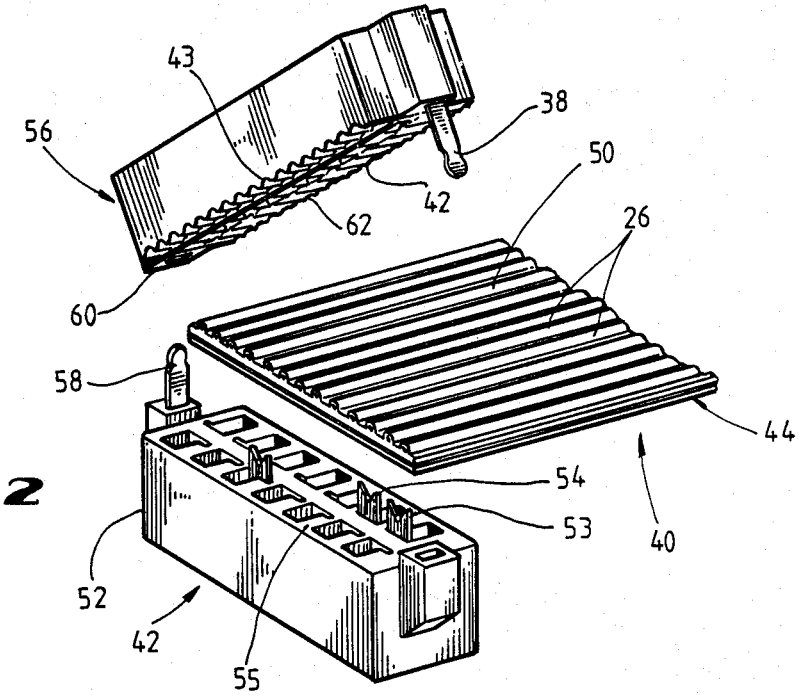
Fig. 2
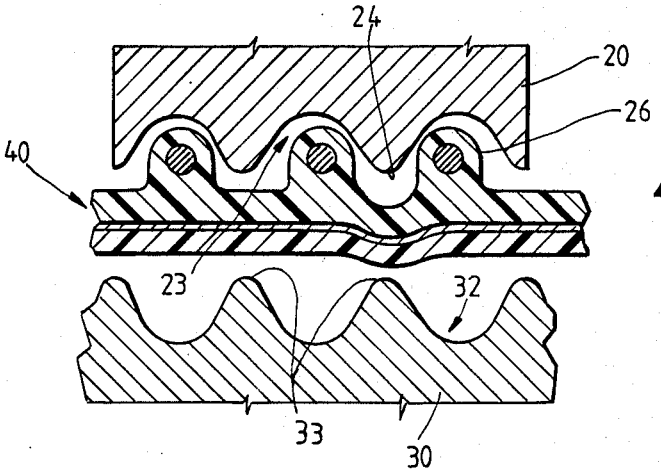
Fig. 11

Fig. 3
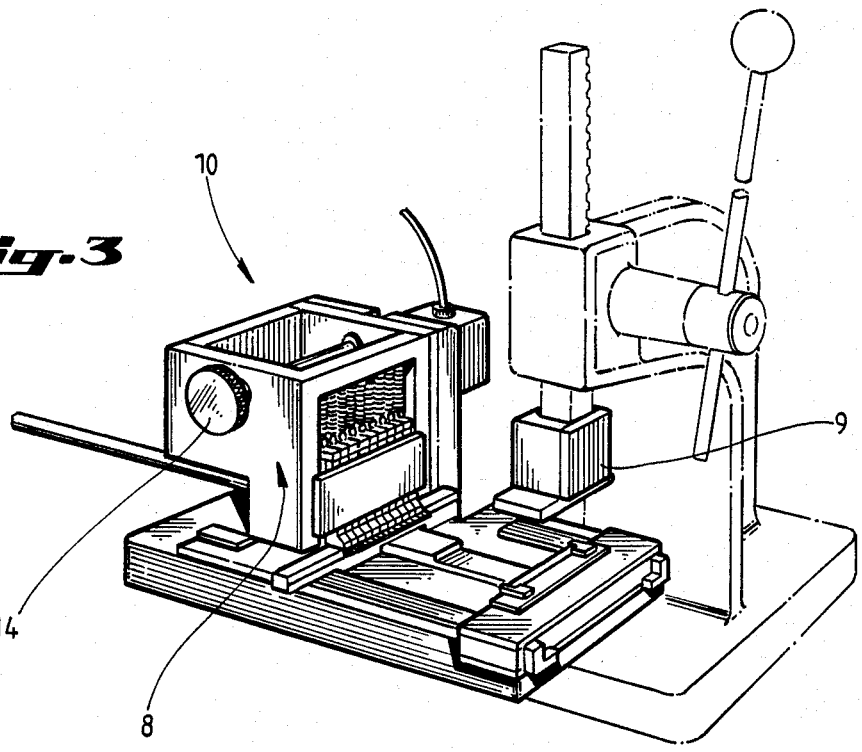
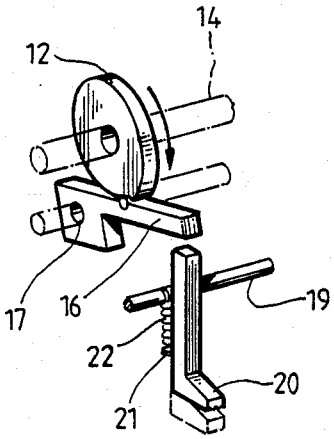
Fig. 9
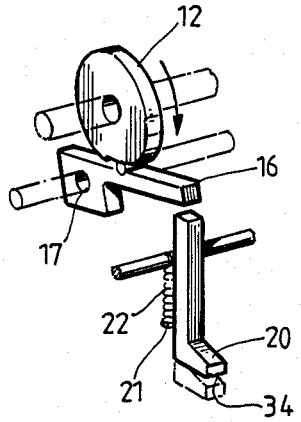
Fig. 8
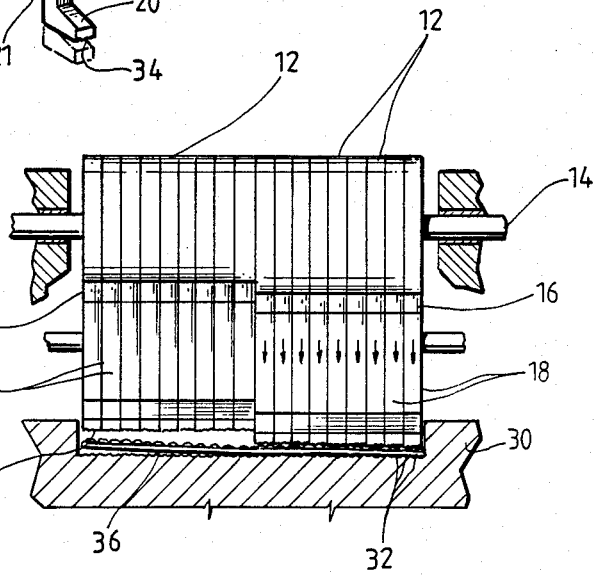
Fig. 10

12
14
16
17
18
19
20
21
22
26
34
11

ASSEMBLY TOOL FOR FLAT CABLE

BACKGROUND OF THE INVENTION

The present invention relates to an assembly tool for applying multi-terminal electrical connectors to multi-conductor flat electrical cable and in particular to an assembly tool which will apply connectors having a plurality of closely spaced insulation piercing terminals onto flat cable having a like plurality of closely spaced insulated conductors.

Mass termination, insulation displacement connectors have come into increasing commercial prominence because of the significant savings in time and labor they offer compared to stripping and individually terminating each conductor using a crimp terminal. These connectors have an insulative housing body holding a number of regularly spaced terminal elements having slotted plates terminating in sharpened free ends extending beyond a surface of the body. The connectors also include covers having recesses in facing surface for receiving the free ends of the plates. After the insulated conductors are aligned with their corresponding slotted plates, relative closing of the housing body and cover results in displacement of the insulation with the conductor cores contacting the metallic plates.

Heretofore, assembly tools for connectors have been available commercially. However, these previous tools for applying connectors have had certain drawbacks. They were open to error in placement of the cable and they required cable with small tolerances on the center to center distance of the conductors. The small tolerances required by conventional assembly tools has made it impossible to use the insulation displacement connector style connectors on some types of cables.

A termination press marketed by Amphenol Products, Lisle, Illinois, has a first handle which is operated part way causing a plate to engage the first five conductors of the flat cable. With the end of the flat cable thus held in the press, the operator pulls the remaining conductors away from the held end. When the remaining conductors are properly aligned, the handle is operated to complete its travel causing the remaining plate sections to hold the remaining conductors of the flat cable in preparation for termination of the flat cable. This is a cumbersome two-step process that requires time-consuming manual manipulation by the operator.

In U.S. Pat. No. 4,393,580 to Hall, Jr. directed to a tool for use with flat cables, a bar is held by a spring member which presses the cable against a fluted surface to hold the cable in preparation for termination. This tool requires that the operator must determine what type of cable is to be used and the number of conductors in the cable for successful operation.

SUMMARY OF THE INVENTION

An assembly tool according to the present invention includes a bottom plate having a plurality of grooves. These grooves are of the proper size and shape to receive a single conductor of a multi-conductor flat cable. A presser portion is made up of a plurality of sequentially operable sliding plates, each plate being individually advanced. Each of the sliding plates has a foot section having a plurality of grooves complimentary to the grooves in the base plate. As each sliding plate is depressed, it forces the conductors directly below the presser plate into the corresponding groove in the bottom plate. After the first presser plate is depressed, the second presser plate is automatically advanced and so on and so forth. By operating each of the sliding plates in sequence, each of the conductors is forced into a corresponding matching groove in the base plate, thereby properly positioning the next set of conductors for proper alignment with the next adjacent set of grooves in the base plate. By the sequential advancement of the presser plates, a difference in the width of the cable as compared to a standard cable, can be tolerated because any compression or stretching necessary to cause the matching of the conductors and their appropriate grooves is done sequentially and the stretching or compression is uniformly distributed across the flat cable.

BRIEF DESCRIPTION OF THE DRAWINGS

FIG. 1 is an end view of the mass terminable flat cable of the present invention;

FIG. 2 is an exploded perspective view showing a mass termination insulation displacement connector usable with the cable of FIG. 1;

FIG. 3 is a perspective view of an assembly tool according to the present invention;

FIG. 8 is a perspective view of a plate assembly from the extreme right of the assembly tool in the rest or raised position;

FIG. 9 is a plate assembly from the extreme left of the assembly tool in the rest or raised position;

FIG. 10 is a planned view from the front of the assembly tool according to the present invention; and FIG. 11 is a plan view from the front of the foot section of the assembly tool and bottom plate.

DESCRIPTION OF THE PREFERRED EMBODIMENT

Figures 4, 5, 6, 7:
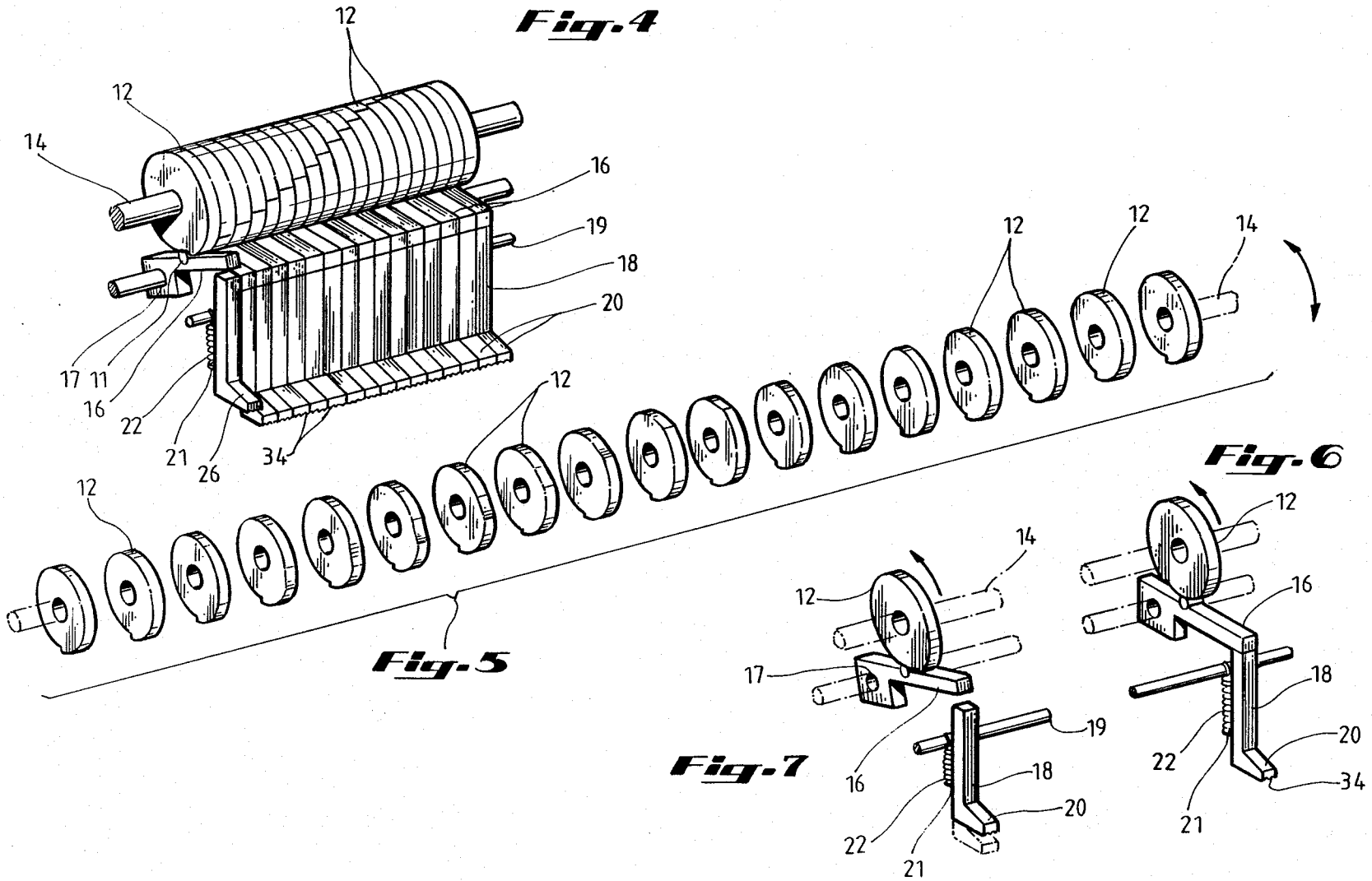
FIG. 4 is a perspective view, partially disassembled, of the presser section of the present invention.
FIG. 5 is an exploded view of the cam section.
FIG. 6 is a view of the plate assembly on the extreme right hand side in a fully depressed position.
FIG. 7 is a perspective view of a plate assembly from the extreme left of the machine in a raised position.

Referring to FIG. 1, the carrier film 24 includes an attachment layer 64 of a thermoplastic insulation having a melting temperature similar to that of the jacket material 30, and a dimensional stabilization layer 66 made of an insulating material having a melting temperature higher than those of the attachment layer and the jacket material and displaying dimensional stability at the melting temperatures of the attachment layer and the jacket material. The jackets 50 of the conductors 26 are fused to the attachment layer 64 and the attachment layer is held by the stabilization layer 66 preferably by bonding them together with an adhesive 68, or the attachment layer and the stabilization layer may themselves be fused. Also preferably the attachment layer 64 and the conductor jackets 50 are made of the same insulating material.

Referring to FIG. 2, a flat cable of the present invention adapted for use with a mass termination insulation displacement connector 42, is generally indicated by reference numeral 40. The flat cable 40 includes a laminated carrier film 44 and a plurality of discrete conductors 26 held in regularly spaced, parallel relationship by the carrier film. Each conductor 26 includes a metallic, i.e., copper, core 28 and an insulating jacket 50 about the core. While the particular flat cable illustrated is intended for carrying electrical signals and has the cores on 0.050 inch centers, it will be appreciated that flat cable 40 in larger sizes for use in supplying electrical power to various electrical components can be used in an assembly tool according to the present invention.

The mass termination connector 42 shown in FIG. 2 is of the high terminal density, signal conductor type and includes an insulative body 52 having two rows of terminal element cavities. A terminal element 53 is disposed in each cavity with elements in each row having a 0.100 inch pitch. Adjacent terminal elements in each row are staggered so that every other conductor 26 is terminated by elements in one row while the remaining conductors are terminated by the elements in the other row. Each terminal element includes a slotted plate 54 extending beyond a surface 55 of the body with the plate terminating in sharpened ends for piercing the web material of the flat cable between the conductors. The plate edges defining the slot function to displace the conductor jacket material so that by forcing a conductor 26 into a slotted plate 54, the conductor core 28 is engaged by the metallic plate to establish an electrical circuit. The connector 42 also includes a cover 56 held in alignment with the body 52 by means of pins 58. The cover, also formed of insulating material, includes a facing surface 60 having pockets 62 for locating the flat cable conductors 26 with respect to the terminal elements 53, and a recess 63 for receiving the free ends of the slotted plates 54. Thus after the flat cable 40 is positioned between the cover 56 and the body 52, relative closing of the two results in mass termination of the conductors 26 of the flat cable 40.

FIG. 3 shows a perspective view of an assembly tool 10 according to the present invention. Presser section 8 is used to align and hold flat cable 40 in place for termination. Termination connector 42 is applied at termination section 9. Intermediate between presser section 8 and termination section 9 is a cutter, not shown. During operation of assembly tool 10, a flat cable would be placed under pressure section 8. Shaft 14 would rotate causing each foot section of presser section, described in more detail below, to sequentially lock in place at the proper spacing distance. Each conductor of the flat cable would then be automatically cut and a termination connector would be applied at termination section 9. Rotation of shaft 14 may be by means of a hand-operated lever or by means of an electric motor.

FIG. 4 shows a perspective view of the presser section 8 of the assembly tool with the protective cover removed. Presser 8 is comprised in general of cams 12, cam followers 16 and sliding plates 18. FIG. 4 shows all of sliding plates 18 in the down or depressed position in with the exception of the sliding plate on the extreme left.

FIG. 5 shows an exploded view of cams 12. Cams 12 have an inclined face 13 so that as the cam is rotated, the inclined face will force roller 11 and cam follower 16 down, forcing sliding plate 18 down. The cams are arranged so that moving from right to left in FIG. 5 the inclined face occurs at a point on the circumference of the cam approximately 15° later than the cam next adjacent on the right.

On the cams 12 on the right hand side of FIGS. 4 and 5, the inclined portion of the cam is found near the rest position and thus drives the slide 18 associated with that cam 12 down early in the clamping cycle. Each subsequent cam, moving right to left in FIGS. 4 and 5, has an inclined portion that is located approximately 15° of rotation later in the clamping cycle than the cam adjacent on the right. Thus, as the cams are rotated in unison, each slide 18 is forced downward approximately 15 rotational degrees after the preceding slide. After the inclined portion on each cam, the cam is relatively constant in diameter.

FIG. 6 shows a cam 12, cam follower 16 and slide assembly on the extreme right hand side of the presser section 8. In FIG. 6 cam 12 has been rotated in the extreme counterclockwise direction. In this position roller 11, has been forced down by the inclined surface on cam 12. Roller 11, in turn, forces cam follower 16 down which pushes slide 18 down.

FIG. 7 shows a cam assembly comprised of cam 12, cam follower 16 and slide 18 on the extreme left hand side of presser section 8. This extreme left cam assembly has a cam 12 with a relatively constant diameter, with an inclined portion at the end of the counterclockwise travel of cam 12. Thus, cam 12 does not engage roller 11 until near the end of travel forcing roller 11, cam follower 16 and slide 18 down. The cam assembly shown has the foot in the rest or raised position.

Spring anchor 19 shown in FIGS. 6–9 remains in a fixed position. As slide 18 moves down, it stretches spring 22 which is attached to eyelet 21 on foot 20. The other end of spring 22 is attached to spring anchor 19. After cams 12, shown in FIGS. 8 and 9, have returned to their original position releasing cam follower 16, spring action pulls slides 18 back up. Thus, it is seen that movement of slides in a downward direction is caused by action of the cam 12 engaging roller 11 forcing cam follower 16 down which forces slide 18 down.

FIG. 10 shows a front end view of the presser section of the assembly tool 10. Presser plate 18 has been moved downward so that the conductors 26 on the right side of the multi-conductor flat cable have been forced into grooves 32 on bottom plate 30. Complimentary grooves 34 on the foot portion of sliding plate 18 align with grooves 32 to hold conductors 26 in position. The next adjacent sliding plate on the left then moves down forcing conductors 26 into alignment with proper grooves 32 and bottom plate 30.

FIG. 11 shows an enlarged view of a planned view of the foot section of the present invention. In this view it is seen that foot grooves 23 and foot ridges 24 match up with plate ridges 33 and plate grooves 32 on bottom plate 30. Thus, conductors 26 are forced into the opening formed when foot 20 is pressed downward against plate 30. In operation it is seen that as foot 20 is moved downward, the slope of groove 23 will force the two conductors 26 on the left to move to the left and the conductor 26 on the right to move to the right thereby taking up the slack in flat cable 40.

In this embodiment, it is shown that each sliding plate has three grooves per foot. However, this is meant to be merely illustrative and the number of grooves per foot may vary from as few as one groove per sliding plate to any number deemed appropriate to adequately hold and stretch conductors in the multi-conductor flat cable. One groove per slide is ideal, space permitting, since it would allow no accumulation of cable tolerance across the width of the foot. However, there is a practical trade off with complexity of the assembly tool and hence manufacturing cost.

In the embodiment discussed, the bottom plate has been shown as having grooves. Having grooves in the foot and the bottom plate allows the flat cable to be inserted with either side up. An alternate embodiment is feasible wherein the bottom plate is manufactured without grooves. In this embodiment the flat cable would have to be placed with the flat portion in a downward position in order for the device to function properly.

As seen from the above description of the present invention, multi-conductor flat cables of any width, up the maximum number of sliding plates and grooves, may be used. Thus, it is not necessary to adjust the present invention for multi-conductor flat cables with different number of conductors.

We claim:

1. An assembly tool for applying a connector having a plurality of insulation piercing electrical terminals onto a multi-conductor flat cable with each terminal engaging a respective conductor, the improvements therein which comprise:

a plurality of sliding plates;

foot means on each of said sliding plates;

at least one groove means on each of said foot means for locating and holding a conductor of said multi-conductor flat cable;

a bottom plate which acts in cooperation with each of said foot means to locate and hold said conductor of said multi-conductor flat cable; and means for operating said sliding plates in a sequential manner such that a first conductor of said multi-conductor flat cable is positively located and held prior to actuation of the next adjacent of said sliding plates and consequent locating and holding of the next conductor in said multi-conductor flat cable.

2. An assembly tool as in claim 1 wherein said bottom plate has grooves which are complimentary with said grooves on said foot means.

3. An assembly tool as in claim 1 wherein each of said foot means has three grooves.

* * * * *